US010766011B2

(12) United States Patent
Mercado Alvarado

(10) Patent No.: US 10,766,011 B2
(45) Date of Patent: Sep. 8, 2020

(54) LIQUID POLYMER ACTIVATION SYSTEM USING A SUBMERSIBLE ACUTATOR

(71) Applicant: Adalberto Mercado Alvarado, Bayamon, PR (US)

(72) Inventor: Adalberto Mercado Alvarado, Bayamon, PR (US)

( * ) Notice: Subject to any disclaimer, the term of this patent is extended or adjusted under 35 U.S.C. 154(b) by 155 days.

(21) Appl. No.: 15/787,758

(22) Filed: Oct. 19, 2017

(65) Prior Publication Data

US 2019/0118148 A1 Apr. 25, 2019

(51) Int. Cl.

| | |
|---|---|
| ***B01F 7/22*** | (2006.01) |
| ***B01F 15/00*** | (2006.01) |
| ***B01F 15/02*** | (2006.01) |
| ***B01F 7/00*** | (2006.01) |

(52) U.S. Cl.

CPC ..... *B01F 7/22* (2013.01); *B01F 7/00733* (2013.01); *B01F 15/00162* (2013.01); *B01F 15/00538* (2013.01); *B01F 15/0243* (2013.01); *B01F 2215/0052* (2013.01)

(58) Field of Classification Search

CPC .. B01F 7/00733; B01F 7/22; B01F 15/00162; B01F 15/00538; B01F 15/0243; B01F 2215/0052

USPC ..... 366/150.1

See application file for complete search history.

(56) References Cited

U.S. PATENT DOCUMENTS

| | | | | | |
|---|---|---|---|---|---|
| 4,242,199 | A * | 12/1980 | Kelley | B01F 3/04609 | 210/197 |
| 4,650,342 | A * | 3/1987 | Goodwin | B01F 7/00733 | 366/264 |
| 5,043,104 | A * | 8/1991 | Stirling | B01F 3/04609 | 210/219 |
| 5,996,977 | A * | 12/1999 | Burgess | B01F 3/04531 | 261/121.1 |
| 2008/0159061 | A1* | 7/2008 | Han | B01F 3/0446 | 366/102 |

* cited by examiner

*Primary Examiner* — Marc C Howell

(74) *Attorney, Agent, or Firm* — Eugenio J. Torres-Oyola; Victor M. Rodriguez-Reyes; Rafael Rodriguez-Muriel

(57) ABSTRACT

The present disclosure is directed to a blending system including a blending mechanism, wherein said blending mechanism comprises a mixing chamber including at least a submersible motor, at least a high shear mixer, at least an impeller and at least a multistage retention time cup.

18 Claims, 15 Drawing Sheets

LIQUID POLYMER ACTIVATION SYSTEM USING A SUBMERSIBLE ACUTATOR

CROSS-REFERENCE TO RELATED APPLICATION

N/A

STATEMENT REGARDING FEDERALLY SPONSORED RESEARCH AND DEVELOPMENT

N/A

BACKGROUND OF THE INVENTION

Field of the Invention

The present invention relates to a submersible mechanical blending mechanism, and more particularly relates to a structure built into a chamber including a polymer/chemical dilution and boosting system mechanically driven by a submersible motor.

Discussion of the Background

Currently mechanical blending system are used for integrated equipments the separation of liquids from solids and vice versa on water treatment plant, waste-water treatment plant, pharmaceutical plant, food and beverage plant, diary, distillery, power plant, industrial plant and mining processing facilities.

Further standard mechanical and non-mechanical blending systems are used as ancillary equipment of liquid/solid separation technologies and play an essential role in sludge dewatering industries. In fact, the separation in sludge dewatering industries will not take place without a polymer blending system. For example, the polymer blending system are used with the following sludge dewatering equipment:

Decanters
High speed centrifuges
Belt filter presses
Gravity Belt thickeners
Rotary Drum thickeners
Plate presses
Screw Presses
Primary and secondary thickeners
Market snapshot Standard mechanical and non-mechanical polymer blending systems use a single energy reaction chamber for dilution and activation of polymer. All of them depend on high inlet water pressure to get or maintain a constant blend if the inlet pressure is low; then the constant blend turns into variable blend. All variable blend the operator will follow two things that will increase consumption costs:

Increase polymer dosing pump capacity
Decrease production to maintain process stability Currently standard mechanical polymer blending systems comprises external motor, water inlet, polymer inlet, mixing device, mixing chamber reaction and blend outlet. The minimum inlet pressure is 30-50 PSI wherein with a low water inlet pressure a poor blend is achieved.

The non-mechanical polymer blending systems comprises a water inlet, poymer inlet, mixing chamber reactor, static mixing device and blend outlet. The minimum inlet pressure is 60 PSI wherein with a low water inlet pressure a worst blend is achieved compared to the mechanical polymer blending system.

Therefore, there is a need for a mechanical blending system that provides a correct and constant blend if the inlet water feed pressure is under 35 PSI and 60 PSI for non-mechanical blender.

SUMMARY OF THE INVENTION

In light of the above shortcomings of the structures available to provide a blending system, the present disclosure provides a mechanical blending system comprising a polymer dilution/activation technology with a submersible motor inside a reaction chamber.

Another object of the present invention is to provide a constant blend. In accordance with the principle of the present disclosure the first exemplary embodiment comprises mixing chamber including at least a submersible motor, at least a high shear mixer, at least an impeller and at least a multistage retention time cup that can be used for submersible applications.

Another objective of the present invention is to provide a higher flow and blending capacities. In accordance with the principle of the present disclosure the first exemplary embodiment integrates a submersible motor, mixing technology and propulsion technology in a single reaction chamber.

Another object of the present invention is to provide a device with more mixing capacity in less space. In accordance with the principles of the present disclosure no external motors are used.

To enable a better understanding of the objectives and features of the present invention, a brief description of the drawing below will be followed with a detailed description of the invention.

DETAILED DESCRIPTION OF THE INVENTION

Figure 1:
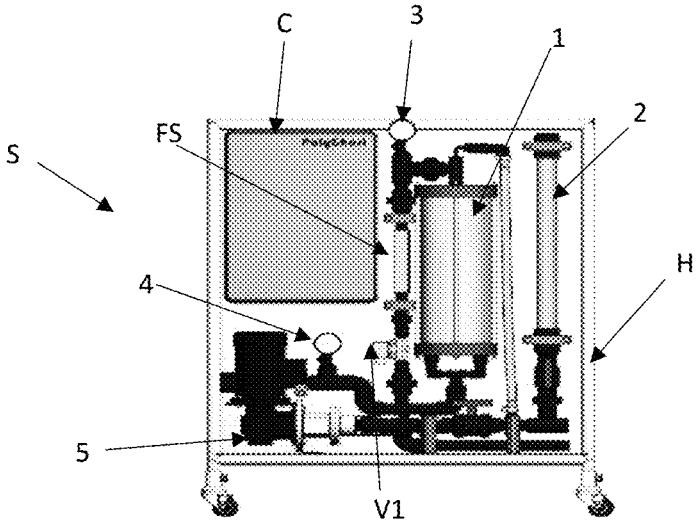
FIG. 1 is an exemplary view of a blending system including a housing and the first exemplary blending skid in accordance with the principles of the present invention.
Figure 2:
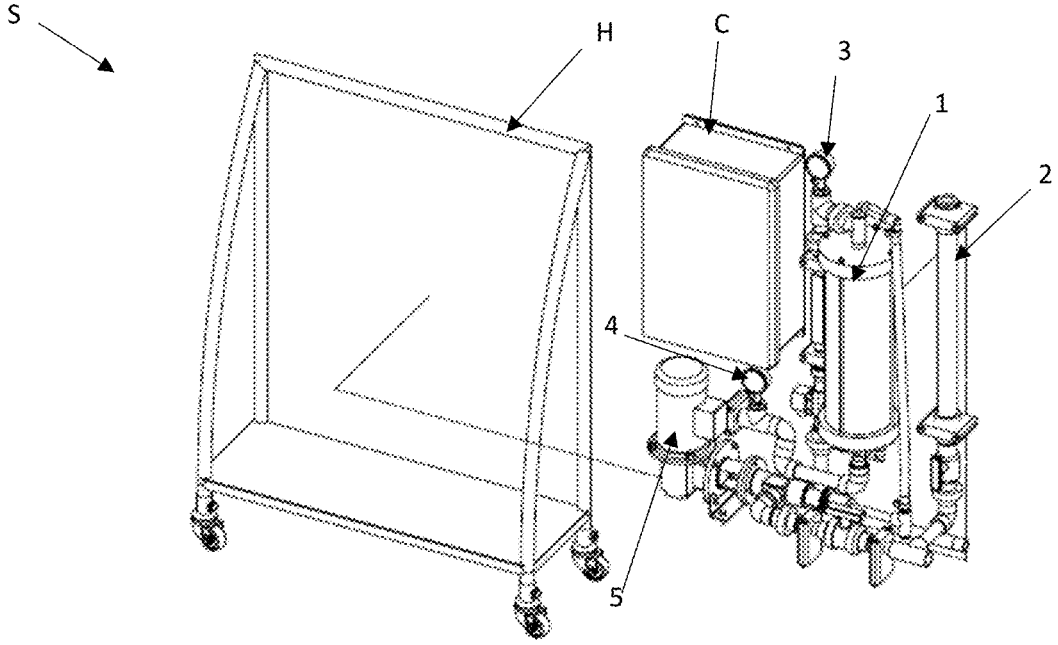
FIG. 2 is an exemplary exploded view of a housing and blending system including the first exemplary blending skid in accordance with the principles of the present invention.

The current disclosure presents several exemplary embodiments wherein each integrated blending system is employed in different environment and/or in combination of different water treatment systems. For example, FIG. 1 and FIG. 2 are exemplary views of a blending system including a housing H and the first exemplary blending system in accordance with the principles of the present invention.

The housing as the frame is made to support the blending system S including all the elements. The blending system S comprises a blending mechanism 1, a control mechanism C, a first substance supplier PA and a second substance supplier PB. The term substance is directed but not limited to liquids, solid particles or any physical matter.

Several pipes are mechanically coupled to provide path for the first substance, such as water, be delivered to the blending mechanism 1. A valve V1 permits the flow of water into the blending mechanism 1. A first pressure indicator 3 indicates the water pressure entering the blending mechanism 1 a second pressure indicator 4 indicates the mix of substances getting out of the blending mechanism 1 through the outlet O.

Another plurality of pipes is used to create a path to deliver the second substance PB, such as a polymer, to the blending mechanism 1. A pump 5 is used to raise or move the second substance into the blending mechanism 1. The selection of the pump 5 depends on the properties of the second substance. For instance, if a polymer or any other substance with viscosity is selected the preferred pump 5 is a progressive cavity pump.

Figure 3:
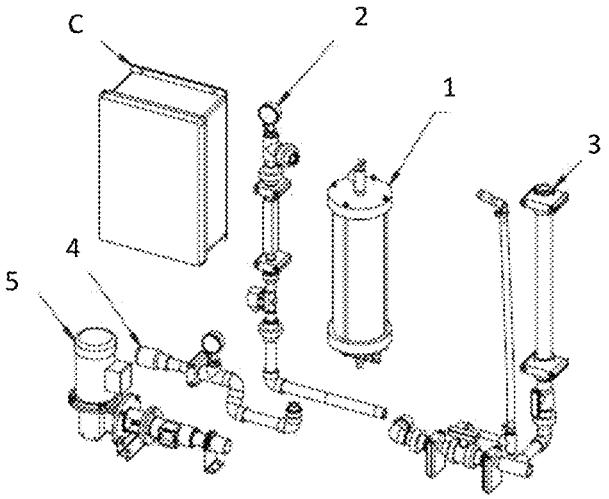
FIG. 3 is an exemplary exploded view of the blending system including the first exemplary blending skid in accordance with the principles of the present invention.

A calibration column, 2 which assists with the calibration of the blending system, is mechanically coupled to the to the system in order to know and calibrate the number of gallons the pump 5 is capable of delivering to the blending mechanism. The calibration column is mechanically couple to the path providing the second substance PB. A valve is used to avoid the second substance to move or direct toward the calibration column while the blending system is mixing the first substance and second substance. FIG. 3 present an exploded view of the elements of the blending system S.

Figure 4A:
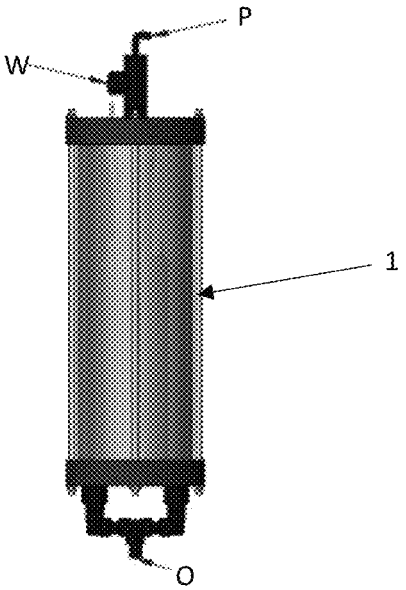
FIGS. 4A 4B are exemplary views of the first exemplary blending mechanism in accordance with the principles of the present invention.
Figure 4B:
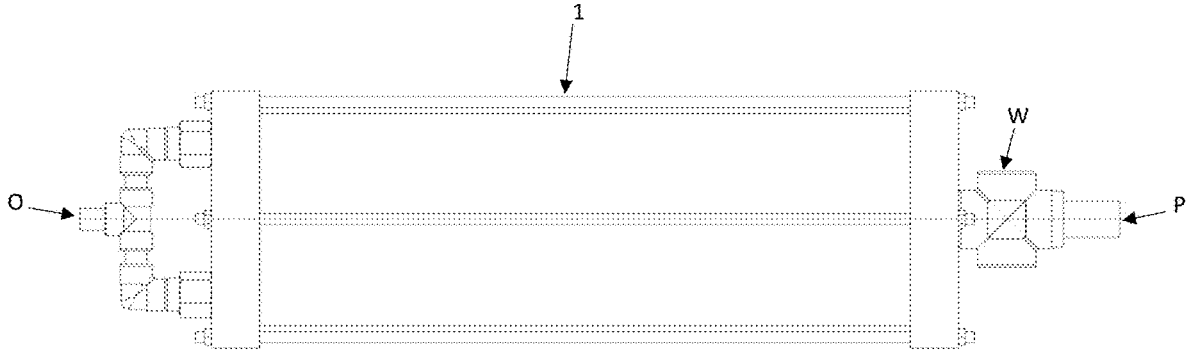

The control panel is electrically coupled to the solenoid valve and pump 5 to control the delivering of the two substances. The control panel further control the actuator mechanism that impart motion of the fluids inside the blending mechanism. FIGS. 4A through 4B are directed to the blending mechanism 1, wherein said blending mechanism comprises at least a first substance inlet W, a second substance inlet P, a mixing chamber and an outlet O, as shown in FIGS. 4A and 4B. In accordance with the principles of the current invention the inlet diameter entering the mechanism is desired to be the same as the mixed substance. Therefore, it is preferred that the same amount that is getting inside the blending mechanism be the same amount leaving the blending mechanism. For example, if a one inch diameter is used as an inlet the outlet could be two exits of a half each per exit.

The blending mechanism 1 comprises a chamber wherein said chamber comprises a first flange F1, a second flange F2 and a cylinder mechanism CO extended between said flanges. Further inside said chamber an actuator mechanism, such as a submersible motor SM, a first retention mechanism 11, a second retention mechanism 12, a propeller IM and a high shear mixer HM is disposed.

The cylinder mechanism CO in accordance with the principles of the present disclosure the cylinder mechanism CO is made of a translucent material, such as clear plastic material. The distal ends of the cylinder mechanism CO are attached to the flanges by studs. The studs press the flanges against the cylinder mechanism CO at the respective distal end. In the instant case, sealing rings or robber gasket are used at the contacting area between the flanges F1, F2 and the cylinder distal ends in order to avoid spilling of the substances outside the chamber.

Figure 5:
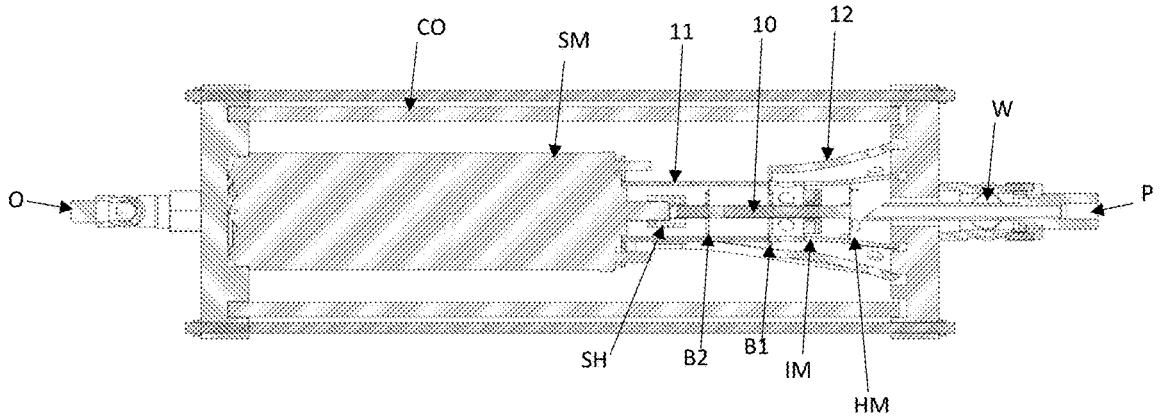
FIG. 5 is an exemplary cross section of the first exemplary blending mechanism in accordance with the principles of the present invention.
Figure 6:
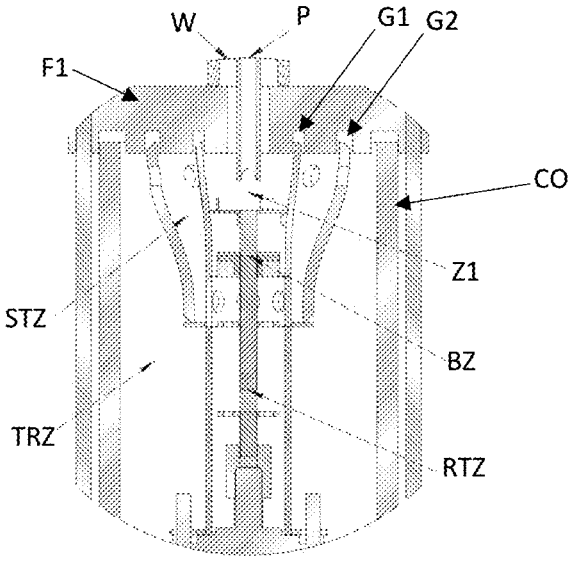
FIG. 6 is a detailed view of the cross section for the top part of the first exemplary blending mechanism in accordance with the principles of the present invention.

As shown in FIG. 5 and FIG. 6 the top flange F1 comprises several grooves to adjust the cylinder and the retention mechanisms. Further include inlets for the first substance W and second substance P. The first substance PA and second substance PB do not contact each other until reaching the first retention mechanism inside the chamber. Once inside the chamber the high shear mixer HM mixes the first substance and second substance. The impeller then pushes the mixed substance toward the actuator mechanism, such as submersible motor SM. The impeller IM and high shear mixer HM are attached to a shaft extension, wherein said shaft extension 10 is coupled to the motor shaft by a shaft coupling unit SH. The shaft rotation actuates the rotation of the impeller IM and high shear mixer HM. The mixed substance is directed to the second retention mechanism 12 by means of holes at the first retention mechanism 11. The first retention mechanism 11 extends toward the submersible actuator SM. A coupling ring CP is used to connect the first retention mechanism 11 with the submersible actuator SM top surface. The connection between the first retention mechanism 11 and the submersible actuator SM avoid filtration of the mixed substance inside the first retention mechanism with the mixed substance outside of the first retention mechanism 11. The shaft extension 10 further include (if preferred) buffer disks B1, B2. The buffer disks assist with the substance mixing. In accordance with the principles of the present disclosure the first retention mechanism 11 and second retention mechanism 12 are mechanically attached to the first flange F1. The retention disk RD attaches the first retention mechanism 11 to the second retention mechanism 12 creating a bottom surface for the second retention mechanism 12.

As shown in FIG. 6, several mixing zones are provided during the mixing of the substances. The first zone Z1 is the area wherein the substance collide for the first time inside the chamber. The second zone BZ is wherein the impeller pushes the mixed substance from the high shear mixer. The third zone RTZ is consider the retention zone wherein the substance are mixed more profoundly due to the interaction with the first retention mechanism walls. Further in accordance with the current configuration the mixed substance are directed to the second retention mechanism 12 through a first set of holes E2 located at the first retention mechanism. The second retention mechanism surround the first retention mechanism 11 and receives the mixed substance. A fourth zone STZ is defined at the inner surface of the second retention mechanism 12. Further, the mixed moved away from the inner wall of the second retention mechanism toward the outer surface trough a second set of holes E3. The mixed substance is then pushed away toward the outlet O passing through a transition retention zone TRZ. In accordance with the principles of the present disclosure the first retention mechanism 11 and second retention mechanism 12 are mechanically attached to the gaps G1, G2 at the first flange F1.

Figure 7:
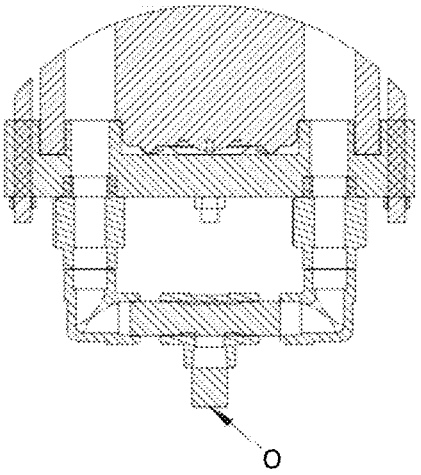
FIG. 7 is a detailed view of the cross section for the bottom part of the first exemplary blending mechanism in accordance with the principles of the present invention.

The submersible actuator mechanism SM, such as a submersible motor, as shown in FIG. 7, is mechanically fixed to the second flange F2. The outlet O is coupled to the second flange F2. As mentioned before it is preferred that the outlet O comprises the same volume capability as the volume of the inlet at the first flange F1 receiving the first and second substance getting inside the blending mechanism 1.

Figure 8:
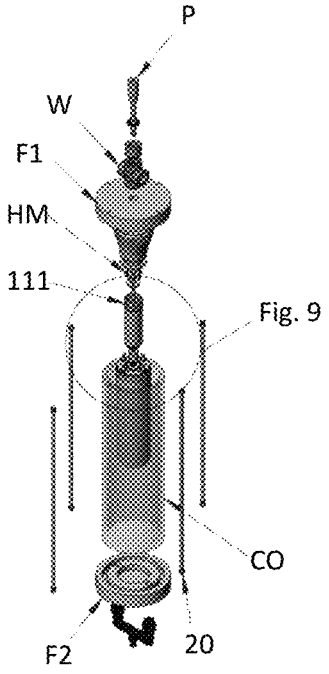
FIG. 8 is an exploded view of the first exemplary blending mechanism in accordance with the principles of the present invention.
Figure 9:
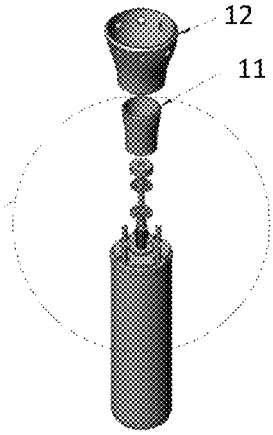
FIG. 9 is an exploded view of the first exemplary blending mechanism inner elements in accordance with the principles of the present invention.
Figure 10:
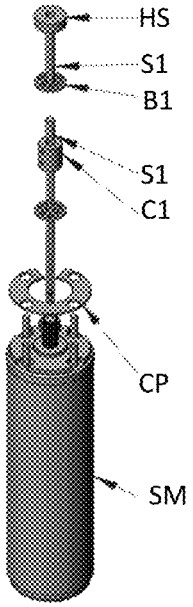
FIG. 10 is another exploded view of the first exemplary blending mechanism inner elements in accordance with the principles of the present invention.
Figure 11A:
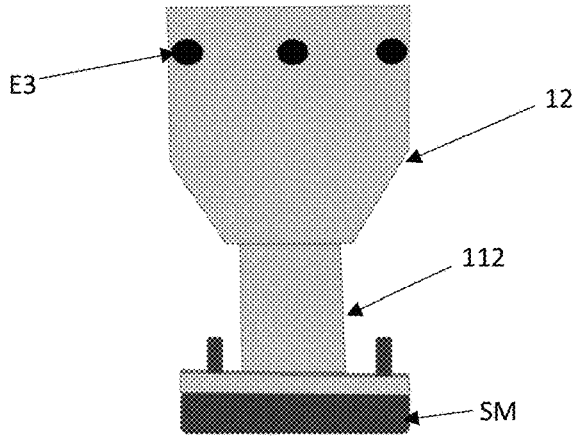
FIGS. 11A-11F are exemplary views of the first exemplary blending mechanism assembly in accordance with the principles of the present invention.
Figure 11B:
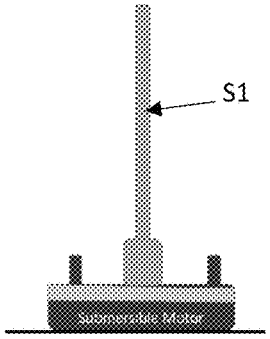
Figure 11C:
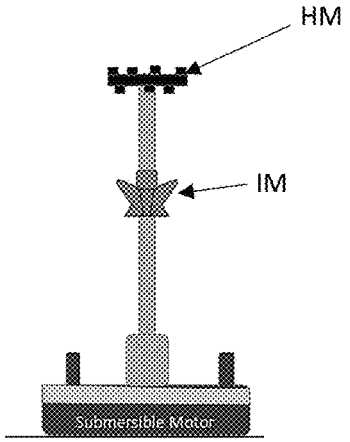
Figure 11D:
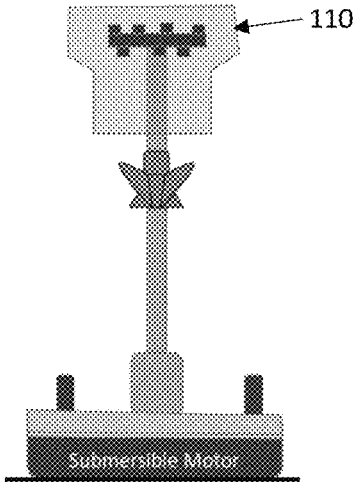
Figure 11E:
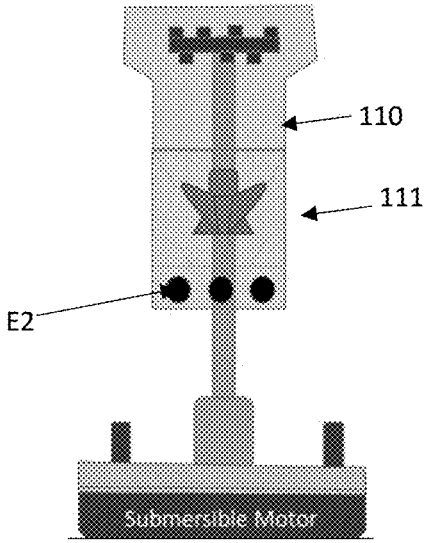
Figure 11F:
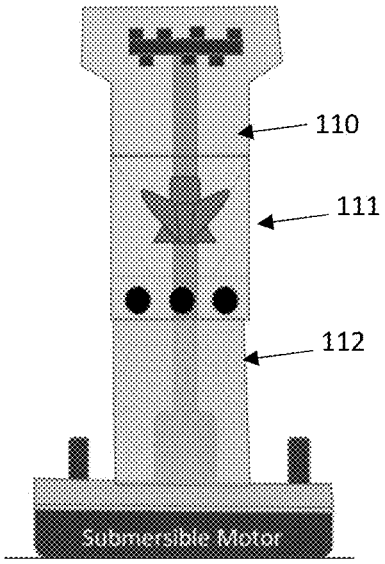

FIG. 8 through FIG. 10 are directed to the blending mechanism 1. FIG. 8 through FIG. 10 show the assembling of the elements above mentioned. The submersible actuator SM is positioned inside the chamber created by the first flange F1, second flange F2 and the cylindrical cover CO, wherein said cover is held in positioned between flanges F1, F2 by means of studs. The inlet of flange F1 receives the first substance and second substance. The coupling ring CP is intended to be positioned on top of the submersible actuator SM, as mentioned above. The shaft extension 10 may include several coupling units CH1 to extend the shaft extension 10 to a preferred elongated distance.

FIG. 11*a* through FIG. 11F shows the connection of elements, as above mentioned, of the submersible motor SM, the first retention mechanism 11, the second retention mechanism 12 and the high shear mixer HM and impeller IM. The first retention mechanism comprises a top cover 110. The top cover surrounds the high shear mixer HM. Further the first retention mechanism 11 comprises a middle body 111, wherein said middle body 111 comprises several holes permitting the flow of the mixed substance. Also the first retention mechanism 11 comprises a bottom body extended toward the submersible motor SM, wherein said bottom body is mechanically attached to the submersible motor.

Figure 12A:
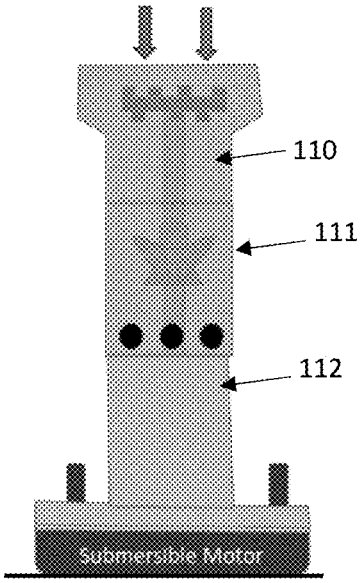
FIGS. 12A-12K are exemplary views of the first exemplary blending mechanism flow in accordance with the principles of the present invention.
Figure 12B:
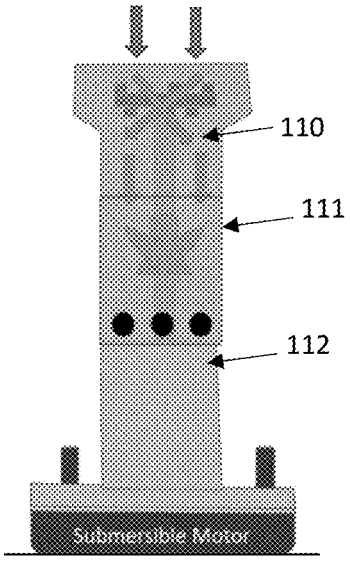
Figure 12C:
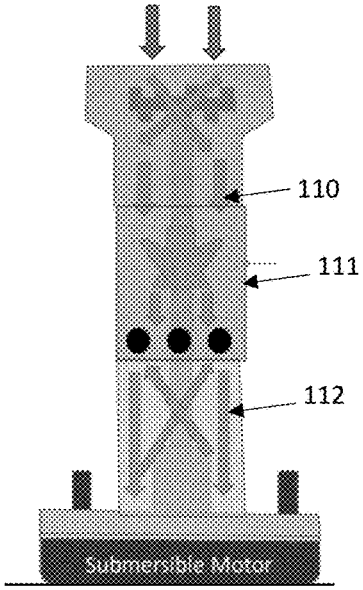
Figure 12D:
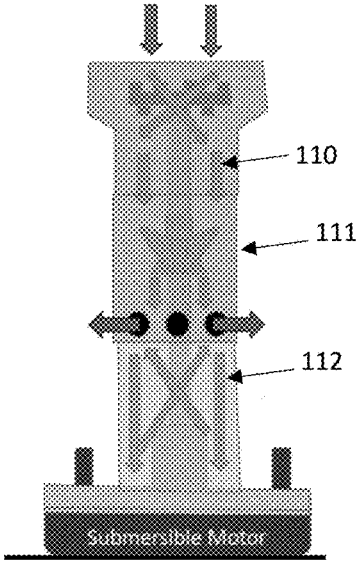
Figure 12E:
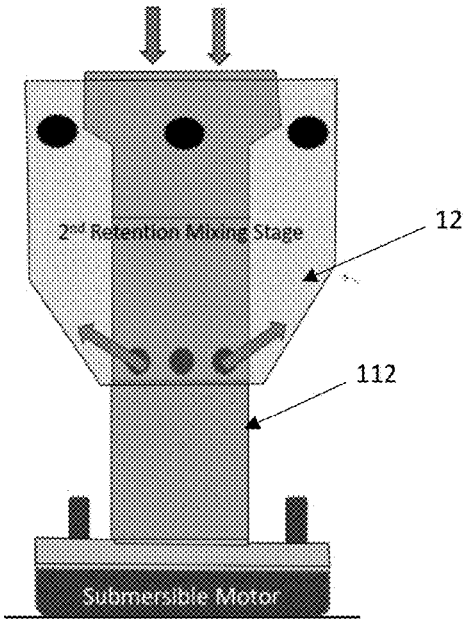
Figure 12F:
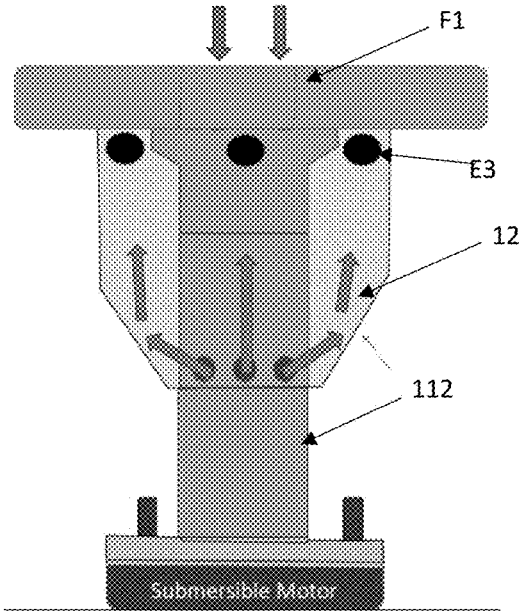
Figure 12G:
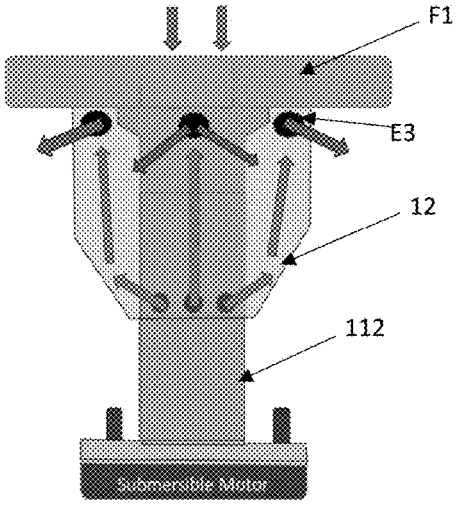
Figure 12H:
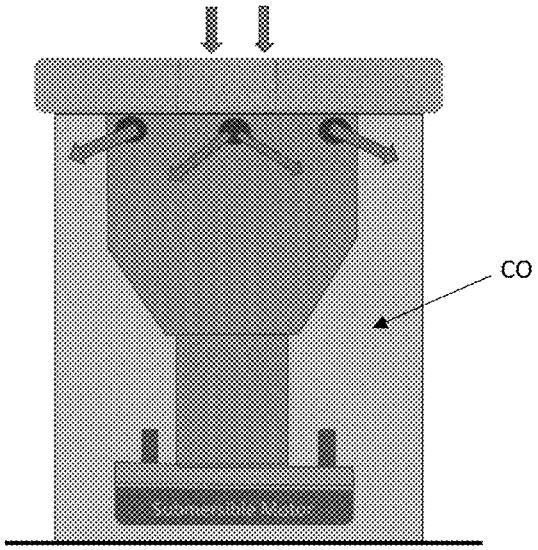
Figure 12I:
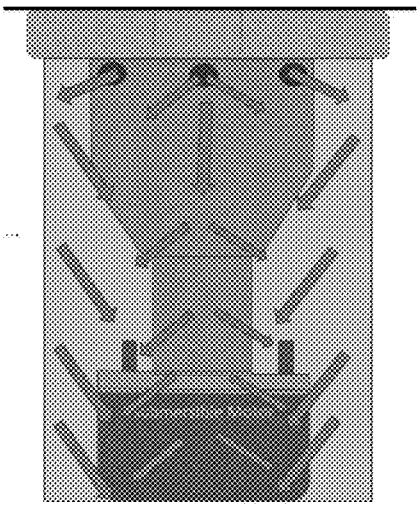
Figure 12J:
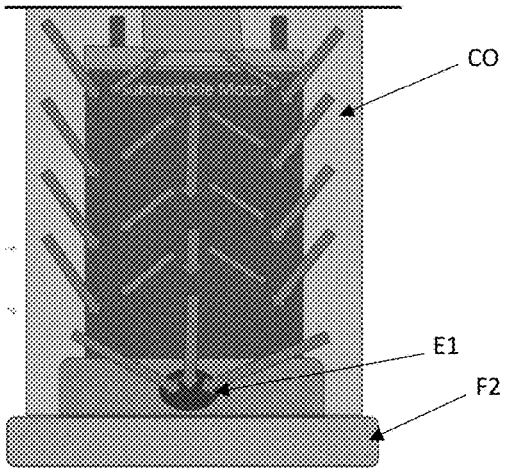
Figure 12K:
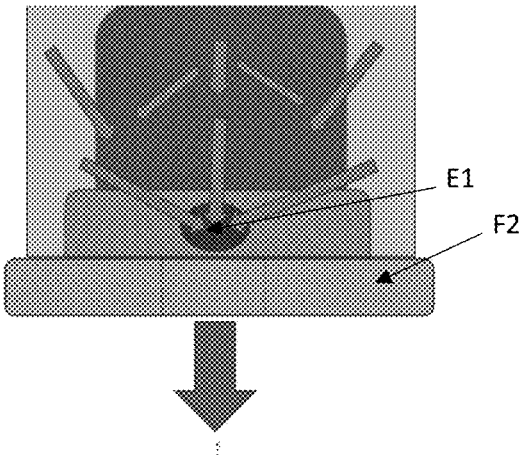
Figure 13A:
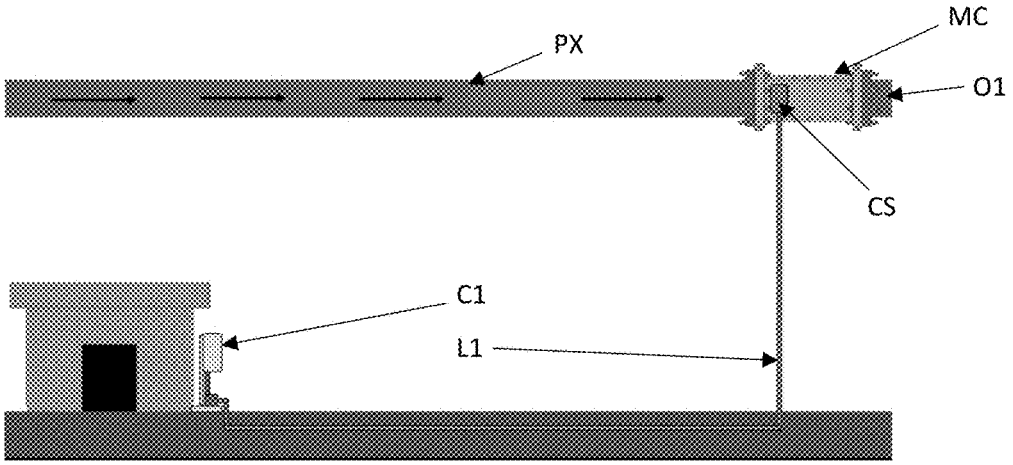
FIGS. 13A-13D are exemplary views of the second exemplary blending mechanism process configuration in accordance with the principles of the present invention.
Figure 13B:
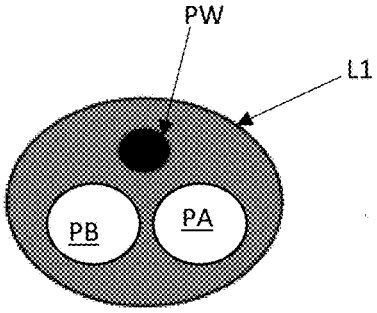
Figure 13C:
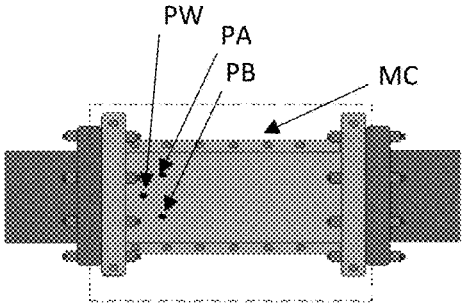
Figure 13D:
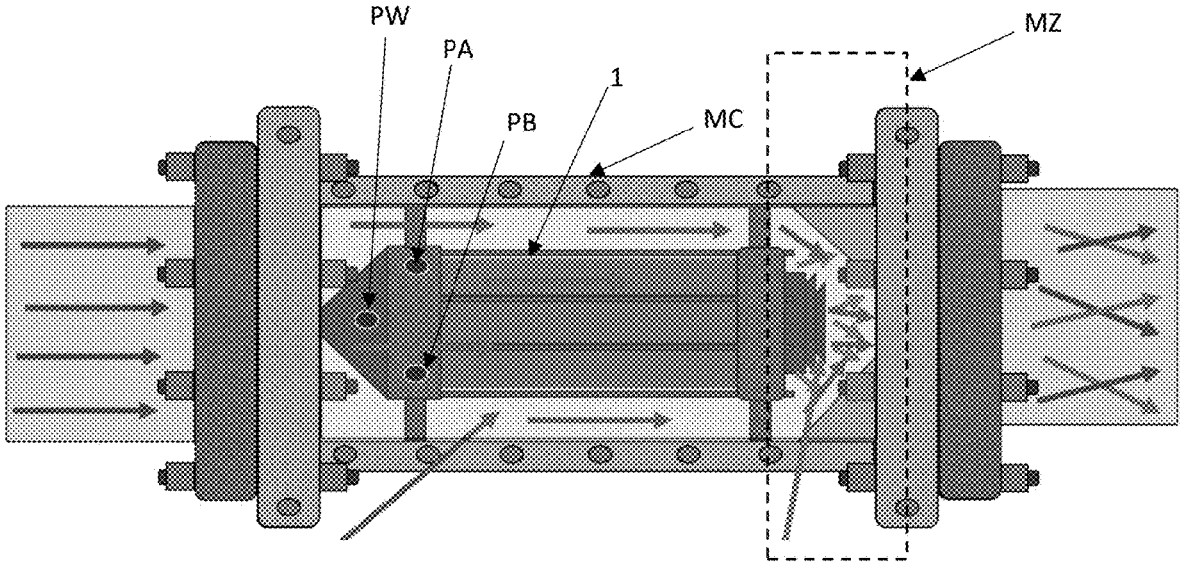
Figure 14A:
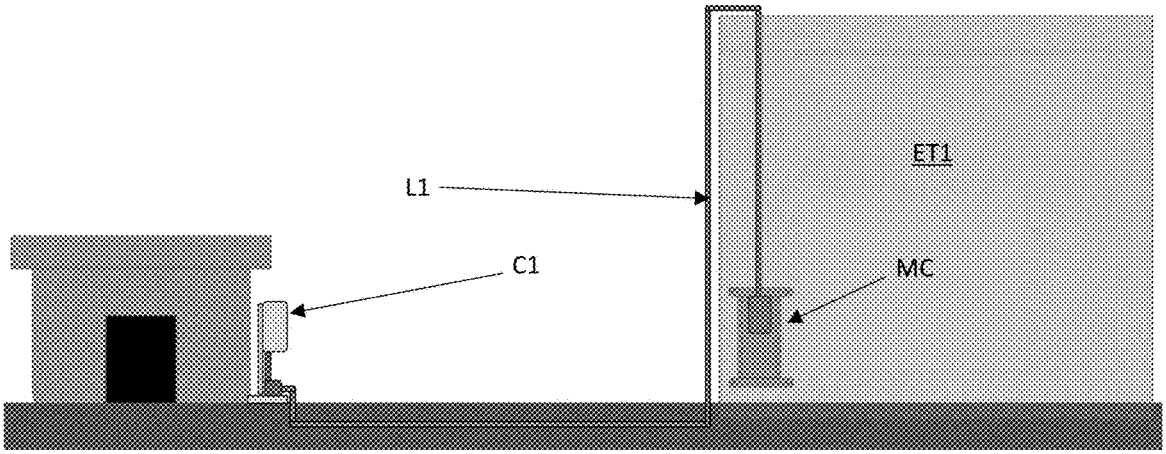
FIGS. 14A and 14B are exemplary views of the third exemplary blending mechanism process configuration in accordance with the principles of the present invention.
Figure 14B:
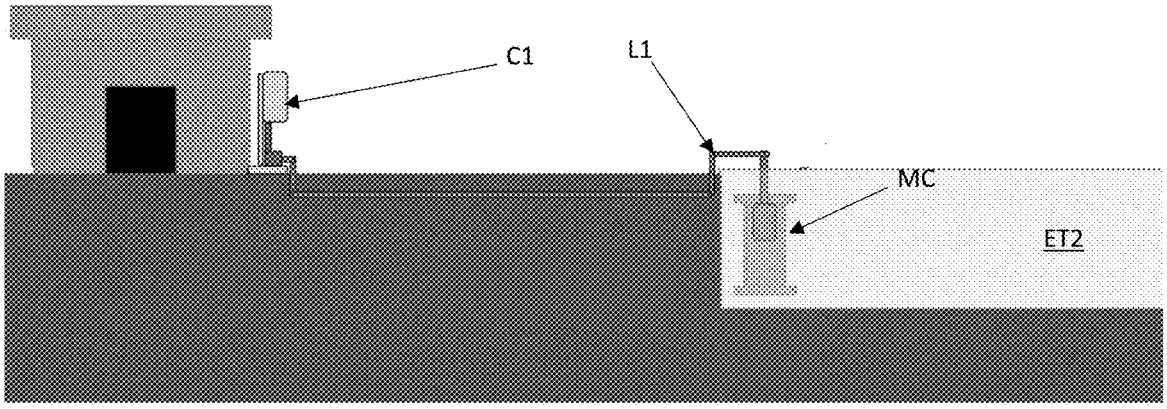
Figure 15:
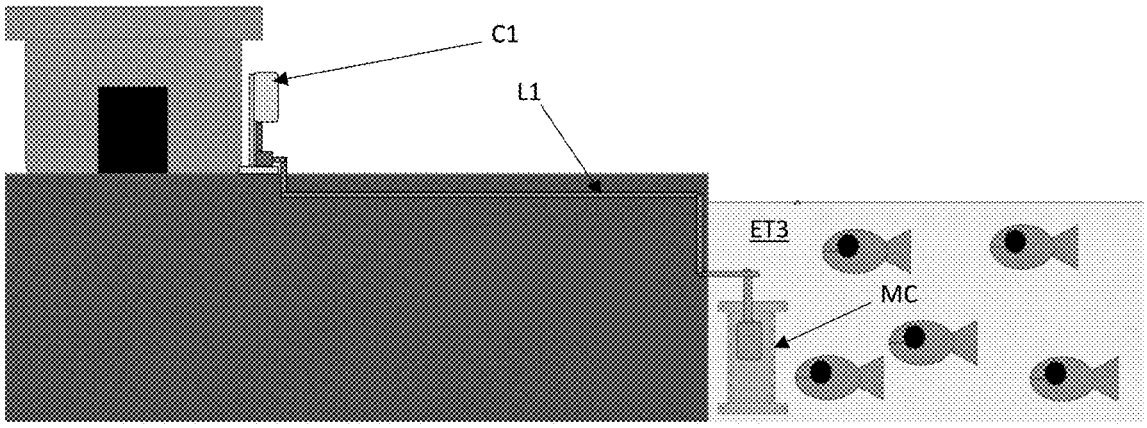
FIG. 15 is an exemplary view of the fourth exemplary blending mechanism process configuration in accordance with the principles of the present invention.
Figure 16:
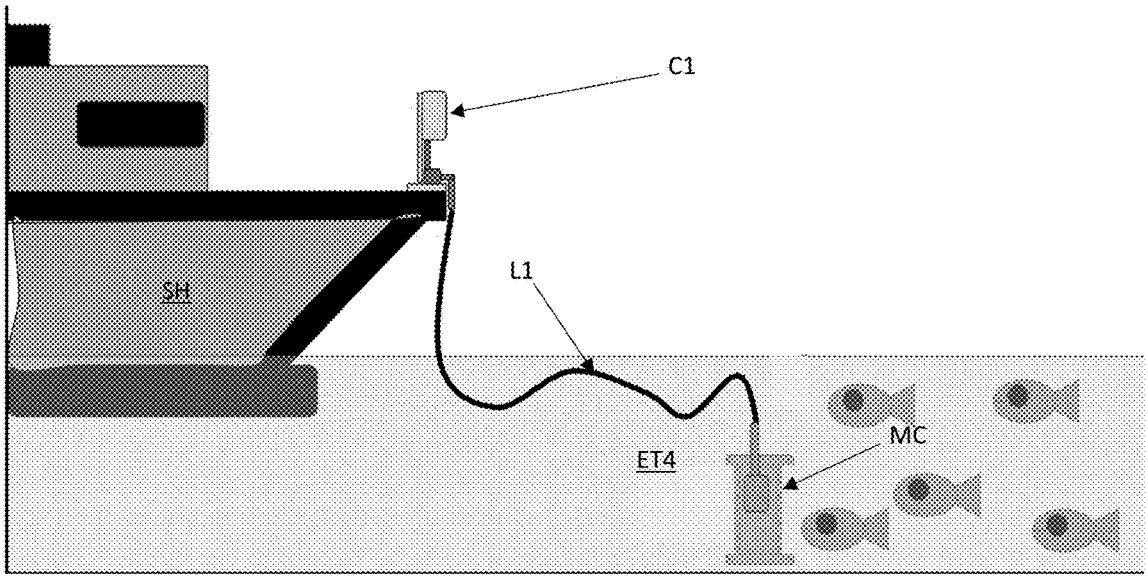
FIG. 16 is an exemplary view of the fifth exemplary blending mechanism process configuration in accordance with the principles of the present invention.
Figure 17:
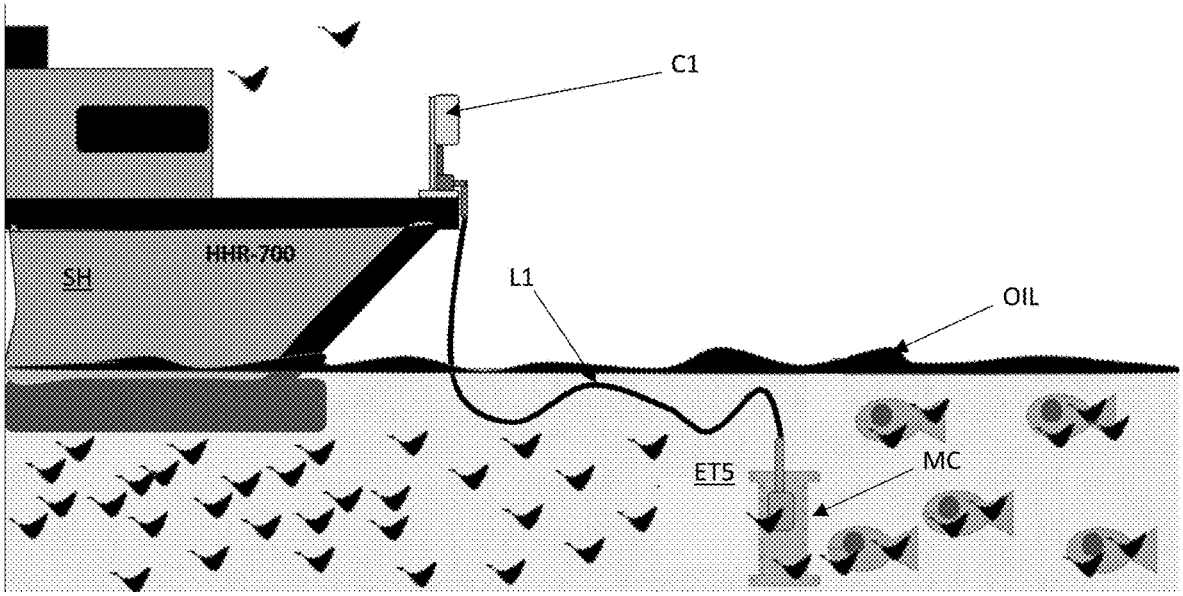
FIG. 17 is an exemplary view of the sixth exemplary blending mechanism process configuration in accordance with the principles of the present invention.
Figure 18:
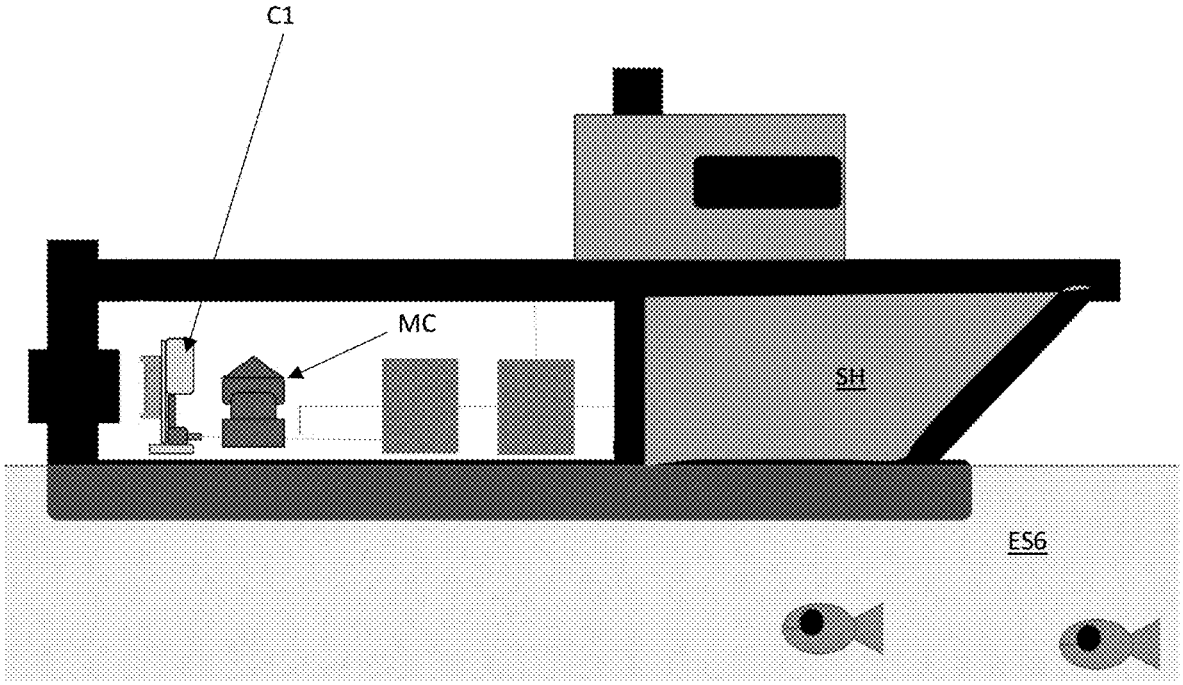
FIG. 18 is an exemplary view of the seventh exemplary blending mechanism process configuration in accordance with the principles of the present invention.
Figure 19:
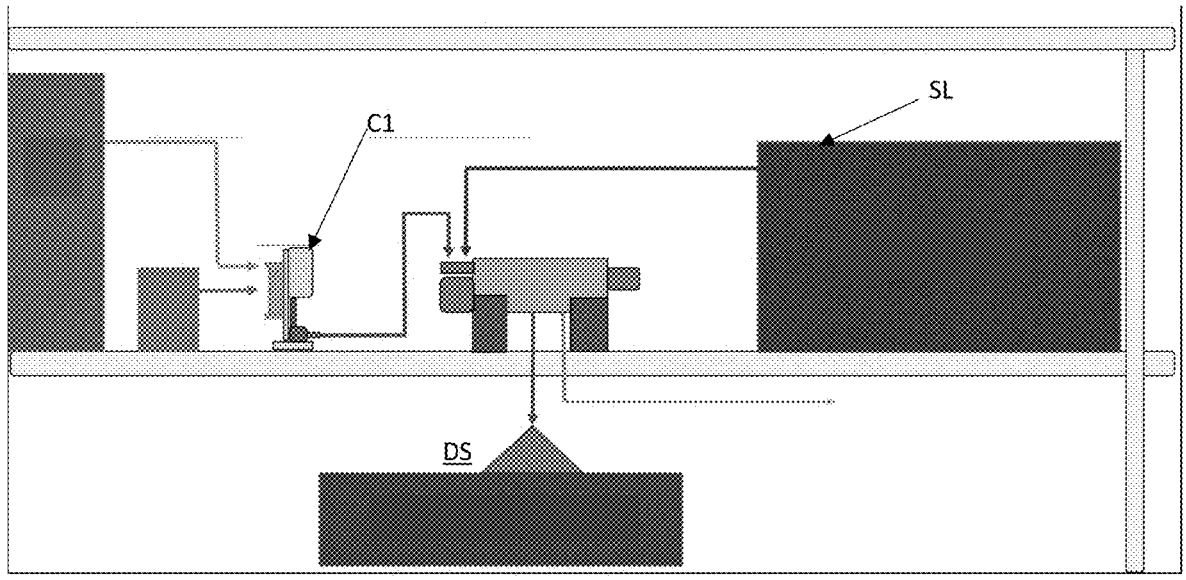
FIG. 19 is an exemplary view of the seventh exemplary blending mechanism process configuration in accordance with the principles of the present invention.

FIG. 12*a* through 12 K are directed to the flow trajectory of the substance in accordance with the principles of the present disclosure. The first retention mechanism receives the first substance and second substance. The substances are mixed by the high shear mixer and moves toward the bottom of the first retention mechanism 11. The impeller moves the mixed substance toward the bottom of the first retention mechanism and assists with the mixing of the first and second substance. The mixed substance is directed to the second chamber through the holes E1 at the middle body. The second retention mechanism 12 receives the mixed substance and direct the mixed substance toward the holes E3 at the second retention mechanism. The mixed substance moves away the second retention mechanism 12 between the outer surface of the second retention mechanism and the cover CO. The mixed substance directs toward the outlet O located at the second flange F2.

The present blending mechanism 1 is intended to mix at least two substances inside a chamber before said mixed substance interacts with an outer environment. Therefor the present blending mechanism 1 is intended to be used in different environments wherein at least a first substance need to be mixed with a second substance before it is deployed to a preferred environment ET1-ET7. For example, FIG. 13A through FIG. 13D discloses the control mechanism C1 coupled to the blending mechanism 1, wherein said control mechanism, as explained above, controls the energy PW supplied to the actuator mechanism or motor M, the supplied first substance and supplied second substance. The energy, first substance PA and second substance PB is preferred to be delivered by a first line L1. As shown from FIG. 14 through FIG. 19, the blending mechanism may be applied to provide a mixed substance for sea life, maintain clean waters, clean water from viscosity such as oil, separate water from sludge SL and others.

In summary of the previous sections, the disclosure presented here is structurally innovative, presents advantages not available at the moment with blending system, complies with all new patent application requirements and is hereby lawfully submitted to the patent bureau for review and the granting of the commensurate patent rights.

While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

What is claimed is:

1. A liquid polymer activation system, comprising:

a cover having a first distal end and a second distal end, wherein each distal end is opposite to each other;

a first flange connected to the first distal end and a second flange connected to the second distal end, wherein such configuration creates a chamber inside the cover that is flanked by the first flange and the second flange;

wherein the first flange comprises at least one inlet for receiving one or more substances and the second flange comprises at least one outlet for releasing the one or more substances;

a submersible actuator connected to the second flange;

a high shear mixer for mixing the one or more substances;

wherein the high shear mixer is connected to a motorized shaft extension which in turn is connected to the submersible actuator, whose rotation rotates the high shear mixer;

a first retention mechanism for receiving the one or more substances;

a second retention mechanism for receiving the one or more substances from the first retention mechanism and wherein said second retention mechanism encircles the first retention mechanism;

wherein said submersible actuator, said high shear mixer, said first retention mechanism and said second retention mechanism are located inside said chamber;

wherein the first retention mechanism and the second retention mechanism are connected to the first flange;

wherein the first retention mechanism is connected to the submersible actuator via a coupling ring;

wherein the at least one inlet leads the one or more substances into the first retention mechanism in which the one or more substances are mixed by the high shear mixer;

wherein the high shear mixer directs the mixed one or more substances towards the submersible actuator;

wherein the mixed one or more substances are then directed by the high shear mixer, through one or more grooves in the first retention mechanism, towards the second retention mechanism; and wherein once in the second retention mechanism, the mixed one or more substances are directed, via one or more openings in the second retention mechanism, towards the at least one outlet.

2. The liquid polymer activation system as in claim 1, wherein said submersible actuator comprises a submersible motor.

3. The liquid polymer activation system as in claim 1, wherein the first retention mechanism encircles the high shear mixer.

4. The liquid polymer activation system as in claim 1, wherein the at least one inlet and the at least one outlet have the same diameter.

5. The liquid polymer activation system as in claim 1, further comprising sealing means located in the area of contact between the first flange and the first distal end.

6. The liquid polymer activation system as in claim 1, further comprising sealing means located in the area of contact between the second flange and the second distal end.

7. The liquid polymer activation system as in claim 6, wherein the sealing means is a sealing ring or a rubber gasket.

8. The liquid polymer activation system as in claim 1, wherein the first flange comprises a second inlet for receiving one or more substances that is separate from the at least one inlet for receiving one or more substances.

9. The liquid polymer activation system as in claim 8, wherein the at least one inlet for receiving one or more substances receives water and the second inlet for receiving one or more substances receives a liquid polymer.

10. The liquid polymer activation system as in claim 1, wherein the first flange comprises one or more grooves adjusted to receive an end of the cover, an end of the first retention mechanism and an end of the second retention mechanism.

11. The liquid polymer activation system as in claim 1, wherein the second flange comprises one or more grooves adjusted to receive an end of the submersible actuator.

12. The liquid polymer activation system as in claim 1, wherein the first retention mechanism includes one or more mixing zones that are separate from each other.

13. The liquid polymer activation system as in claim 1, wherein the second retention mechanism includes one or more mixing zones that are separate from each other.

14. The liquid polymer activation system as in claim 1, wherein the submersible actuator is always in contact with the one or more substances while the liquid polymer activation system is in use.

15. The liquid polymer activation system as in claim 1, wherein the cover is cylindrical.

16. The liquid polymer activation system as in claim 1, further comprising a housing for storing the cover.

17. The liquid polymer activation system as in claim 1, further comprising an impeller attached to the motorized shaft extension.

18. The liquid polymer activation system as in claim 3, wherein the second retention mechanism encircles the first retention mechanism.

* * * * *